US005172619A

United States Patent [19]

Kolve

[11] Patent Number: 5,172,619

[45] Date of Patent: Dec. 22, 1992

[54] SINGLE SIDE CUTTER TOOTH WITH FACING RAKER TOOTH

[76] Inventor: Gerald C. Kolve, 5833 Southwest Lane Ct., Portland, Oreg. 97221

[21] Appl. No.: 808,081

[22] Filed: Dec. 11, 1991

Related U.S. Application Data

[63] Continuation of Ser. No. 264,100, Oct. 28, 1988, abandoned.

[51] Int. Cl.[5] ..... B27B 33/14

[52] U.S. Cl. ..... 83/13; 83/833; 83/834

[58] Field of Search ..... 83/830–834, 83/13

[56] References Cited

U.S. PATENT DOCUMENTS

| | | | |
|---|---|---|---|
| 834,251 | 10/1906 | Bailey . | |
| 1,671,295 | 5/1928 | Kirby . | |
| 2,060,547 | 11/1936 | Arsneau . | |
| 2,308,847 | 1/1943 | Wolf . | |
| 2,326,854 | 8/1943 | Hassler . | |
| 2,327,233 | 8/1943 | Wolf . | |
| 2,351,738 | 6/1944 | Blum . | |
| 2,387,064 | 10/1945 | Forrest . | |
| 2,565,502 | 8/1951 | Johanson . | |
| 2,622,636 | 12/1952 | Cox . | |
| 2,652,076 | 9/1953 | Bye . | |
| 2,658,537 | 11/1953 | Ackley . | |
| 2,695,042 | 11/1954 | Donley . | |
| 2,736,352 | 2/1956 | Wright . | |
| 2,762,227 | 9/1956 | Tweedie . | |
| 2,774,396 | 12/1956 | Gommel . | |
| 2,792,035 | 5/1957 | Aumann . | |
| 2,796,895 | 6/1957 | Van Ranst . | |
| 2,832,380 | 4/1958 | Crowe . | |
| 2,857,942 | 10/1958 | Mall . | |
| 2,891,586 | 6/1959 | Wright . | |
| 2,984,269 | 5/1961 | Gates, Sr. . | |
| 2,986,180 | 5/1961 | Irgens . | |
| 3,020,942 | 2/1962 | Hill . | |
| 3,028,889 | 4/1962 | McCarty . | |
| 3,155,129 | 11/1964 | Edmunson . | |
| 3,167,100 | 1/1965 | Consoletti . | |
| 3,189,064 | 6/1965 | Frederickson . | |
| 3,346,025 | 10/1967 | Anderson et al. . | |
| 3,366,150 | 1/1968 | Malloff | 83/833 |
| 3,543,817 | 1/1970 | Anderson . | |
| 3,545,508 | 12/1970 | Tupper . | |
| 3,613,749 | 10/1971 | Geurian . | |
| 3,745,870 | 7/1973 | Lemery . | |
| 3,748,942 | 7/1973 | Ross, Jr. . | |
| 3,951,027 | 4/1976 | Arff . | |
| 3,977,288 | 8/1976 | Goldblatt et al. . | |
| 4,348,926 | 9/1982 | Dolata et al. . | |
| 4,387,615 | 6/1983 | Lemery . | |
| 4,414,876 | 11/1983 | Loigerot . | |
| 4,426,900 | 1/1984 | Lemery . | |
| 4,567,803 | 2/1986 | Anderson . | |
| 4,576,078 | 3/1986 | Kolve . | |
| 4,762,044 | 8/1988 | Kolve . | |

FOREIGN PATENT DOCUMENTS

| | | |
|---|---|---|
| 724784 | 2/1955 | European Pat. Off. . |

*Primary Examiner*—Frank T. Yost
*Assistant Examiner*—Eugenia A. Jones
*Attorney, Agent, or Firm*—Seed and Berry

[57] ABSTRACT

A saw chain made according to the present invention includes cutter teeth having a single slicer. Sequentially, the cutter tooth having a slicer on the left-hand side is followed by a raker tooth having an open face on the left-hand side. A cutter tooth having a single slicer on the right-hand side is followed by a raker tooth having an open face on the right-hand side. The wood is cut sequentially by the left-hand slicer, the raker tooth having an open face on the left-hand side, the right-hand slicer and the raker tooth having an open face on the right-hand side. The particular sequence of cutting provides a fast and smooth cut that avoids binding in the kerf. Alternatively, the cutter tooth having a single slicer on the left-hand side may sequentially follow a cutter tooth have a single slicer on the right-hand side. A raker tooth having a full-width raker may follow the sequential cutter teeth or two raker teeth having respective half-width rakers may follow.

27 Claims, 8 Drawing Sheets

SINGLE SIDE CUTTER TOOTH WITH FACING RAKER TOOTH

CROSS-REFERENCE TO RELATED APPLICATION

This application is a continuation of U.S. application Ser. No. 07/264,100, filed Oct. 28, 1988, now abandoned.

TECHNICAL FIELD

This invention relates to a saw chain, and more particularly, to a particular combination of cutter teeth and raker teeth on the saw chain links to enable the saw chain to cut faster and smoother.

BACKGROUND ART

When cutting wood with a chain saw, the user desires a quick and smooth cut. The user also desires to avoid binding of the saw chain during the cut.

Binding may occur when a portion of the saw chain which is not cutting the wood contacts the wood. For example, the sides of a raker teeth or a cutter teeth may rub against the sides of the wood within the kerf after the cut is made. The rubbing may be so severe as to stop the action of the saw chain. When the timber has a larger diameter than the width of the saw chain guide bar, the saw chain may also rub against the wood as it passes through the previously cut kerf, while the chain is running on the top side of the guide bar while the saw chain on the lower portion of the guide bar attempts to cut deeper into the kerf.

Many different configurations of saw chains have been used in the prior art to provide a saw chain having a smooth action which avoids binding of the saw chain during the cut. An example of a prior saw chain is disclosed in Lemery, U.S. Pat. No. 3,745,870. When cutting with this saw chain, two grooves are simultaneously cut in the kerf by a pair of opposed side slicers, the slicers being on the same cutter tooth and being mirror images of each other. The cutter tooth is followed by a raker tooth having a leading depth gauge. A saw chain having a pair of mirror-imaged slicers simultaneously cutting the kerf has a tendency to bind in the kerf on soft or wet wood. Further, cutting with this saw chain may impose excessive power requirements on the saw, resulting in overheating or damage to the motor. Moreover, saw chains of this type cannot acceptably execute cuts at an angle with respect to the wood grain.

DISCLOSURE OF THE INVENTION

It is therefore an object of this invention to provide a saw chain which cuts smoothly and rapidly.

It is another object of this invention to provide a method of cutting wood which is smooth and rapid on different types of wood and when making bucking, rip and angle cuts.

It is another object of this invention to provide a saw chain which cuts a kerf significantly wider than the physical width of the saw chain to prevent binding of the saw chain in the cut.

It is another object of this invention to provide a saw chain which cuts soft or wet wood with less binding in the kerf than previously possible.

These and other objects of the invention are accomplished by providing a cutter tooth wit a single slicer for slicing a groove in one side of the kerf followed by a raker tooth having an open face towards the side of the kerf in which the groove was cut by the slicer tooth. A cutter tooth with a single slicer for slicing a groove in the other side of the kerf is followed by a raker tooth having an open face towards that side of the kerf. The method of cutting wood by first slicing a groove in the wood using a slicer tooth followed by a raker tooth having an open face towards that side of the kerf in which the groove has been sliced, provides a faster, smoother cutting action than previously possible with other saw chain designs. The above objects are accomplished with unique combinations of slicers and rakers, each specially designed for a specific function.

DETAILED DESCRIPTION OF THE INVENTION

Figure 1:
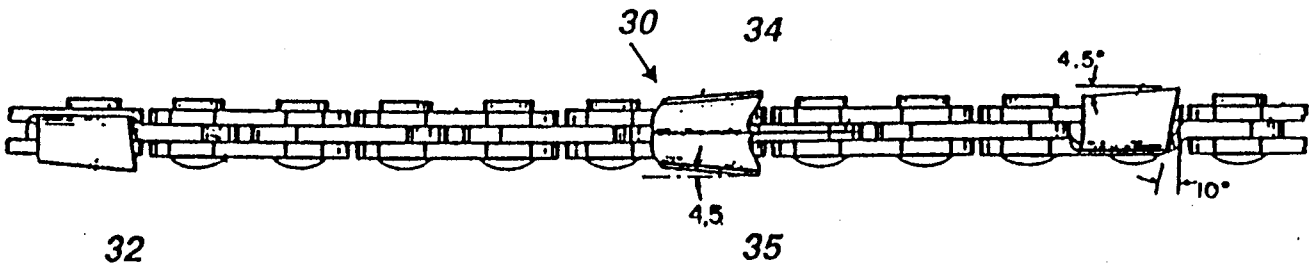
Figure 1 Prior Art
FIG. 1 is a top plan view of a prior art saw chain.
Figure 3:
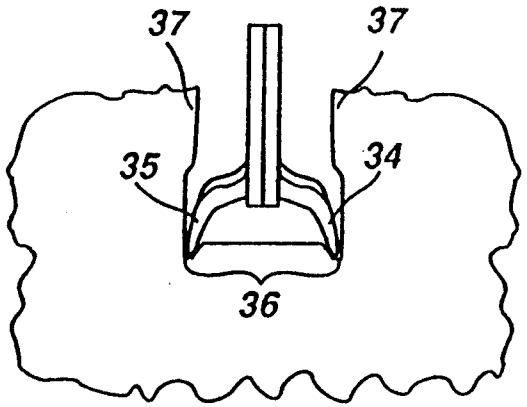
Figure 3 Prior Art
FIG. 3 is a cross-sectional view of a prior art slicer tooth cutting the wood.
Figure 2:
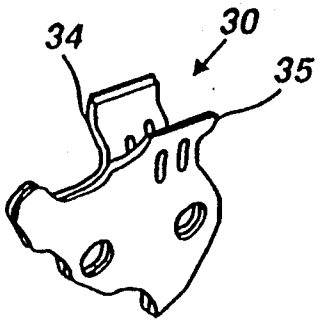
Figure 2 Prior Art
FIG. 2 is an isometric view of a slicer tooth of the prior art.

Saw chains of the prior art include the saw chain of U.S. Pat. No. 3,745,870, to Lemery, as shown in FIG. 1. The saw chain includes a cutter tooth 30 followed by a raker tooth 32. The cutter tooth 30 has two slicers, a right-hand slicer 34 and a left-hand slicer 35 rigidly coupled together on a single cutter tooth 30, as shown in FIGS. 2 and 3. The slicers simultaneously cut into the kerf when the saw chain is cutting the wood. If one of the slicers of cutter tooth 30 moves slightly to one side or the other, the other slicer moves with it because the slicers 34 are part of the same cutter tooth 30. The two grooves made in the wood by slicer tooth 30 will always be spaced apart from each other the same distance, which is approximately equal to the distance between the tips of the slicers 34 and 35. In the event the individual slicers flex outward, the grooves may be slightly wider than the physical width of the cutter tooth 30; however, the additional width is limited to the distance that the slicers 34 and 35 can bend due to any side force generated during cutting.

A further problem is encountered using the saw chain of FIG. 1 when cutting certain types of wood. After the kerf has been cut and wood removed from the kerf, the wood expands to partially fill the kerf which has just been cut, as shown by the region 37 of FIG. 3. The amount of expansion has been magnified to illustrate the problem. The expansion of the wood increases with time following the cutting of the wood. After a few moments, the expansion of the wood may be significant, depending on the quality and state of the wood. The kerf 36 thus becomes narrower after the cut has been made due to this expansion of the wood. When the expansion is significant, the kerf may become smaller than the physical width of the distance between the slicers 34 and 35 of the cutter tooth 30, causing the tooth to rub against the side of the kerf. This may cause excessive load on the engine and possible binding of the saw chain in the cut. Similar problems may occur with full-width raker teeth simultaneously striking both sides of the kerf. Binding may also occur as the saw chain enters the kerf at the top of the guide bar, for wood having a diameter greater than the chain saw guide bar width.

Figure 5:
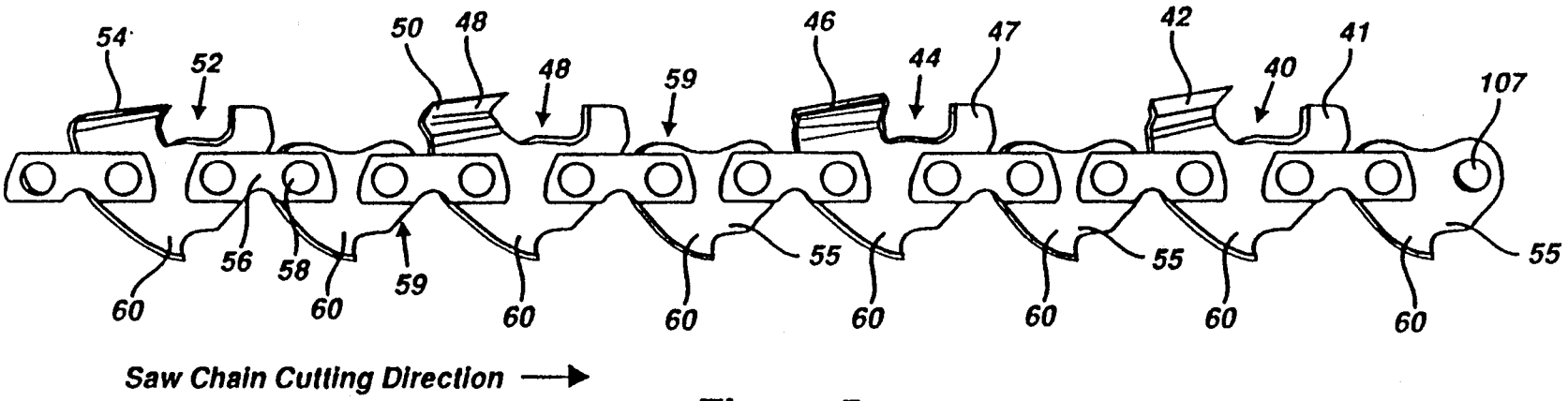
FIG. 5 is a side elevational view of the saw chain of FIG. 4.
Figure 6:
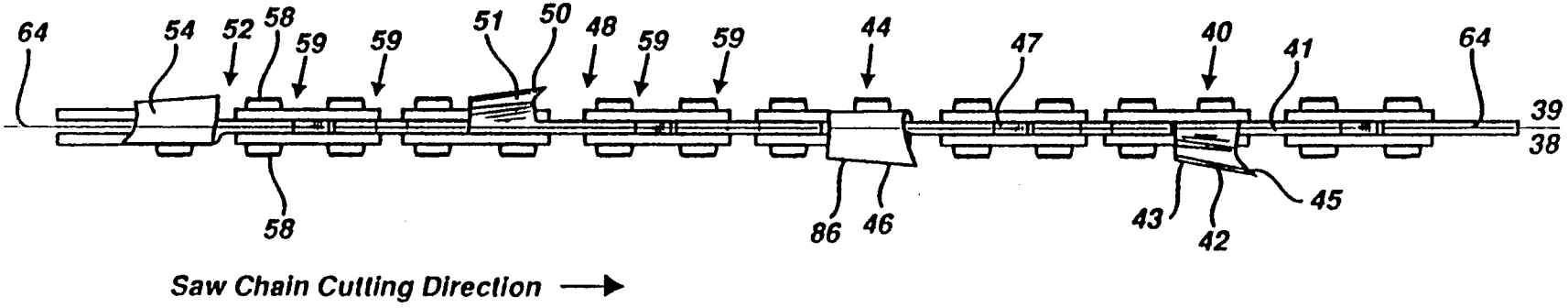
FIG. 6 is a top plan view of the saw chain of FIG. 4.
Figure 7:
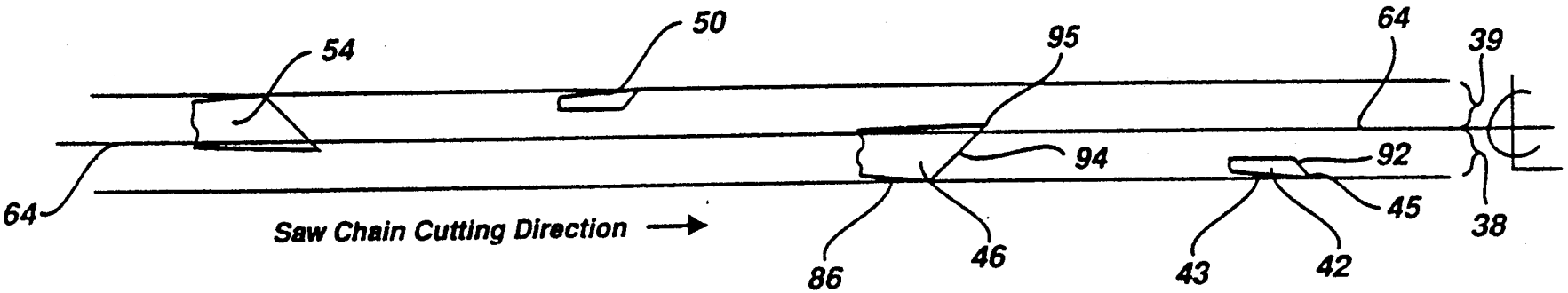
FIG. 7 is a top plan view of the sequence of teeth in the saw chain.

The saw chain made according to the current invention includes a single slicer on each cutter tooth followed by a raker tooth having an open face on the same side of the saw chain of the slicer of a preceding cutter tooth, as shown in FIGS. 4–7. Viewing the saw chain while making a cut, the saw chain traveling towards the viewer, the saw chain has a center plane 64, a left-hand side 38 and a right-hand side 39 on the respective sides of the center plane 64, as shown in FIG. 7. The saw chain includes a cutter tooth 40 having a left-hand side slicer 42 sequentially followed by a raker tooth 44 having a raker 46. The raker tooth 44 has an open face on the left-hand side, the same side as the sequentially preceding slicer tooth. Sequentially following the raker tooth 44 having an open face on the left-hand side is cutter tooth 48, having a slicer 50 on the right-hand side. Sequentially following the cutter tooth having the slicer 50 on the right-hand side is raker tooth 52, having a raker 54. The raker tooth 52 has an open side on the right-hand side, the same side as the slicer of the preceding cutter tooth.

The saw chain elements and individual teeth may be constructed according to any one of many designs well known to those of ordinary skill in the art. For example, the saw chain includes spacer links 55 coupled with side links 56 to the cutter teeth and raker teeth. The number and size of spacer links 55, side links 56 and relative spacing between the teeth may be selected following any one of many designs, as is currently known in the art. In the preferred embodiment of this invention, there is a single spacer link 55 coupled between respective cutter teeth and raker teeth. Alternatively, two or more spacer links 55 may be provided between the cutter and raker teeth.

The cutter teeth, spacer and raker teeth links are center-mounted and coupled together using rivets 58 and side links 56. Each of the teeth and spacer links includes a root 60 for engaging the drive sprocket of the saw chain engine. Alternatively, the cutter teeth and raker teeth may be side-mounted and coupled together with spacer links acting as the drive links, as is known in the art. The saw chain is constructed into a single loop, as is known in the art and disclosed in U.S. Pat. Nos. 4,426,900; 3,745,870, to Lemery; U.S. Pat. No. 4,576,078, to Kolve; and U.S. Pat. No. 2,326,854, to Hassler, all of which are incorporated herein by reference.

Figure 4:
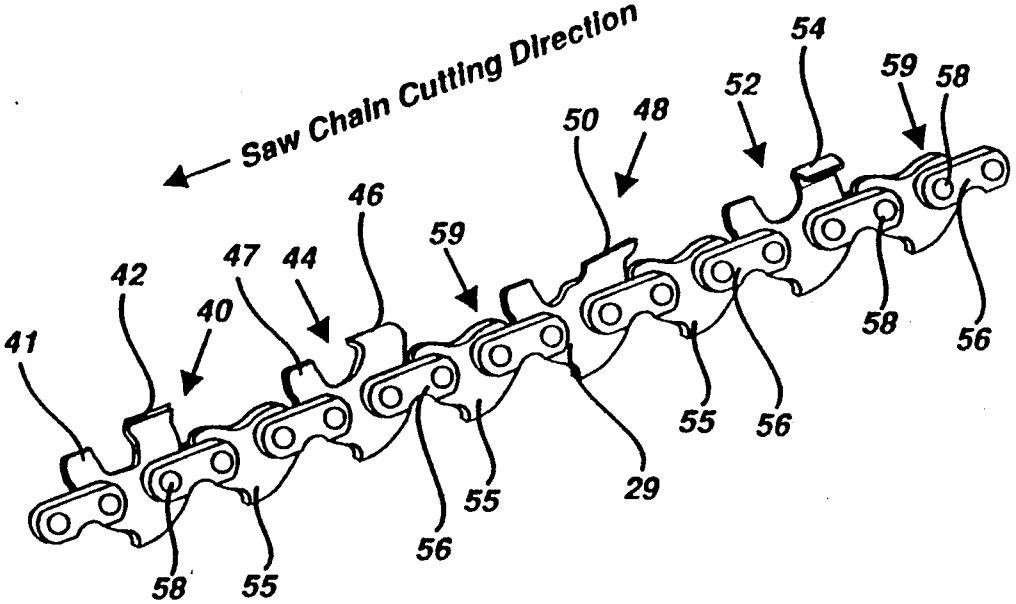
FIG. 4 is an isometric view of the saw chain of the present invention.

The particular design of the slicer and raker teeth shown in FIGS. 7 and 17–18 is preferred, though other designs may be used. In FIG. 7, the slicers and rakers are enlarged to illustrate the slopes and other features of the teeth. Cutter tooth 40 includes an integral, leading depth gauge 41 and a slicer 42 on the left-hand side, the slicer having a leading point 45 and a distal edge 43 extending along its length. The leading edge 92 is sloped backwards, toward the center plane 64 of the saw chain, from the leading point 45. The distal edge 43 is also sloped backwards, towards the center plane 64 of the saw chain from the leading point 45, as can be seen from FIGS. 6 and 7. The distal edge 43 slopes back at approximately 5°, though the slope may be somewhat more or less than this if desired. The angle at which the leading edge 92 slopes backward and engages the wood aids to force the distal edge 43 away from the center of the kerf 80. The leading edge 92 may extend straight across, as shown in FIG. 4, generally perpendicular to the direction of motion of the saw chain. A suitable slicer is shown in U.S. Pat. No. 4,762,044 to Kolve. Though more or less of a slope of the leading edge may be used, the leading edge, as shown in FIG. 7, has been found to be suitable in the saw chain made according to the invention.

Figure 18B:
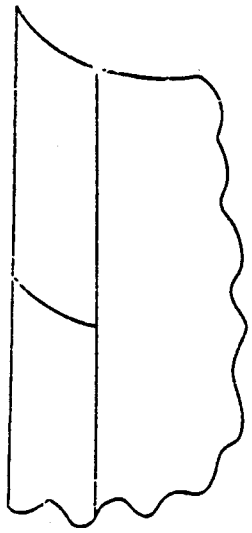
FIGS. 18*a*–18*c* are are top, side and end views, respectively, of a raker.
Figure 18D:
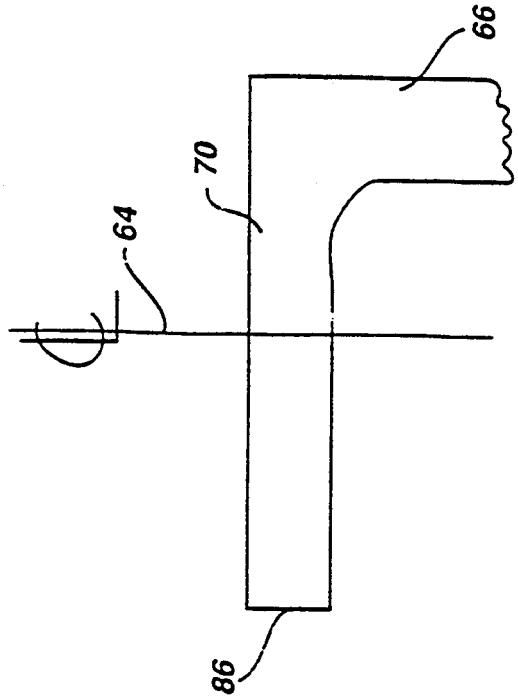
FIG. 18*d* is a side elevational view of an alternative raker.
Figure 18A:
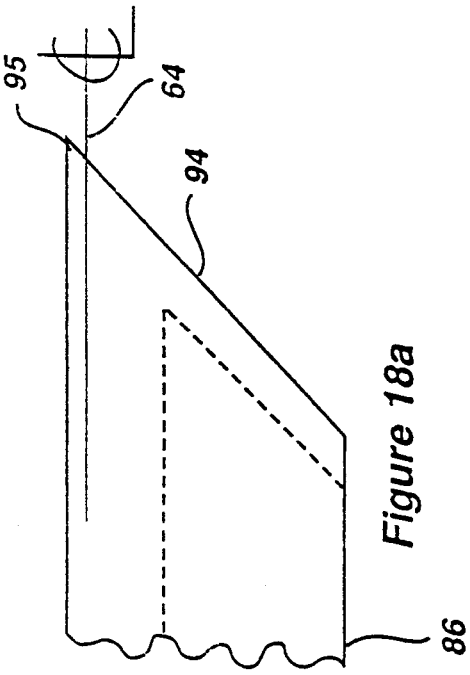

A raker tooth 44 having an integral leading depth gauge 47, a body portion 66, a raker portion 46, a leading point 95 and a distal edge 86 is illustrated in FIGS. 18*a* –18*b*. The raker tooth has a leading edge 94 sloping backwards, towards the outside, from the leading point 95. The leading edge 94 slopes backwards towards the open face side of the raker tooth. This slope aids to pull the raker tooth towards the center of the kerf and ensures that the distal edge 86 does not contact the side 70 of the kerf. In the embodiment of FIG. 7, the slope of the leading edge of the raker teeth is opposite the slope of the leading edge of the corresponding slicer tooth. This particular combination of slopes on sequential slicer and raker teeth has been found advantageous for a saw chain made according to the present invention.

Alternatively, a leading edge 94, which is not significantly sloped but extends generally straight and perpendicular to the direction of movement of the saw chain having no leading point 95, may be used for the raker tooth if desired, as shown in the embodiments of FIGS. 5 and 6. If the raker has a leading edge 94 which extends substantially perpendicular to the center plane 64 of the saw chain, the raker portion 46 must be sufficiently narrow n width that the distal tip 86 does not contact the sides 69 and 71 of the kerf while the raker tooth is cutting into the bottom of the kerf.

Figure 7A:
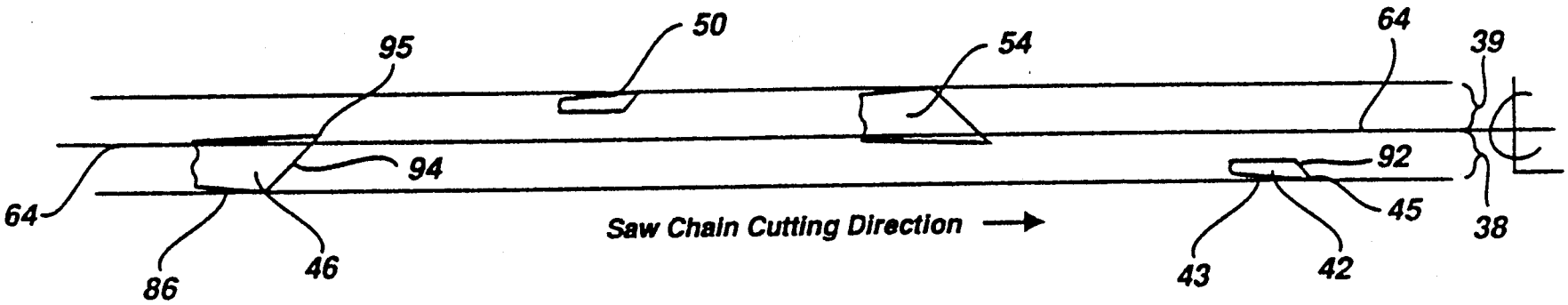
FIG. 7*a* is a top plan view of an alternative embodiment of the sequence of teeth in the saw chain.

An alternative embodiment of the order of the teeth in the saw chain is illustrated in FIG. 7*a*. According to the alternative embodiment, a half-width raker 52 having an open face on the right-hand side 39 follows a cutter tooth 40 having a slicer 42 on the left-hand side 38 and a half-width raker 44 having an open face on the left-hand side 38 follows a cutter tooth 48 having a slicer 50 on the right-hand side 39. The body portion of the half-width rakers is positioned near the center of the kerf and the distal edge is adjacent the side of the kerf. In the alternative embodiment, the distal edge is on the opposite side of the kerf than the groove cut by the preceding slicer tooth.

Figures 8, 9, 10, 11, 11A, 12:
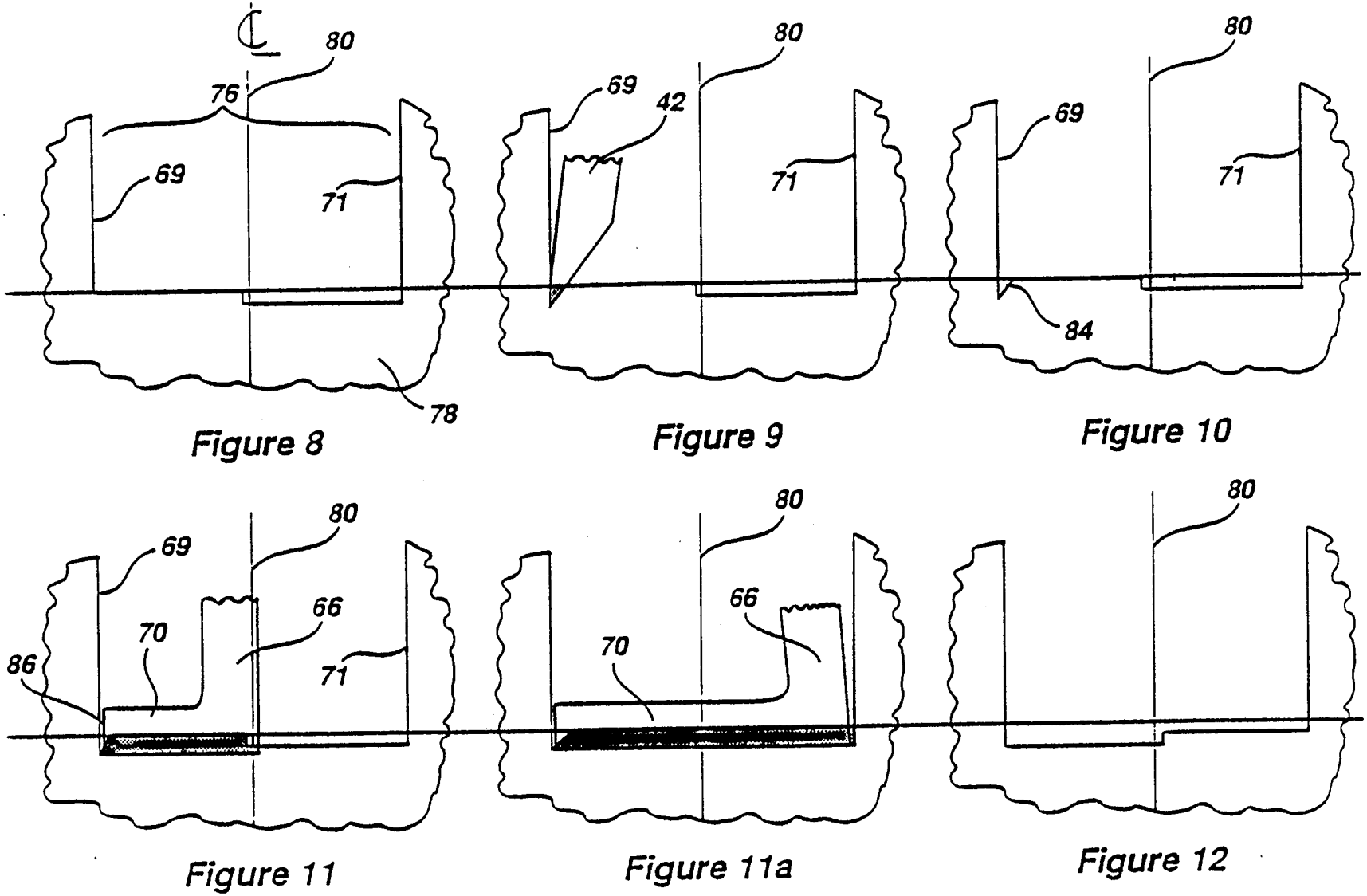
FIGS. 8–16 illustrate the cutting of wood following the sequence according to the present invention.
Figure 13:
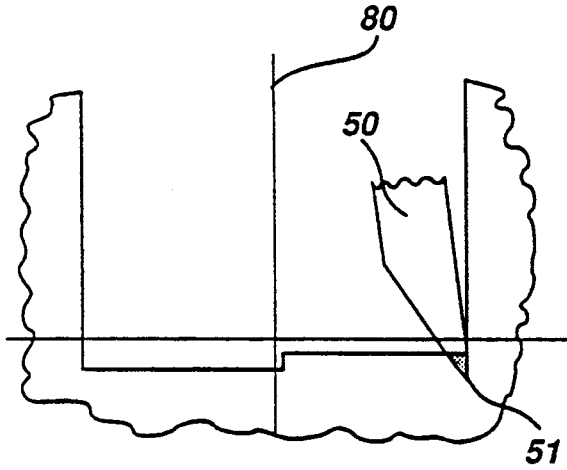
Figure 14:
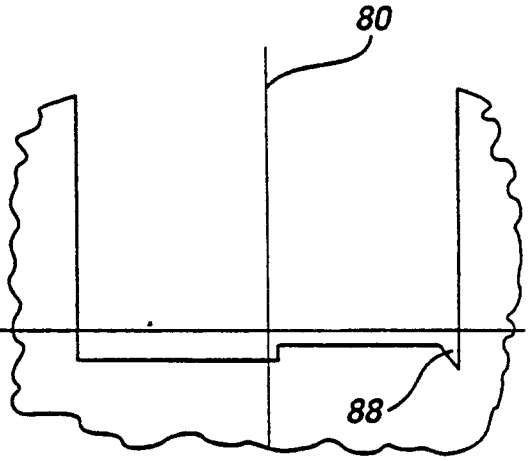
Figure 15:
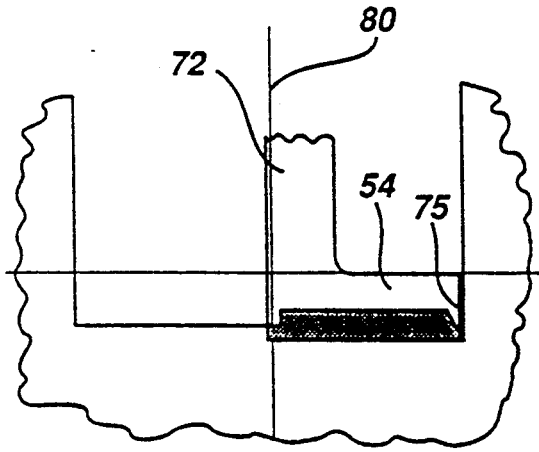
Figure 18C:
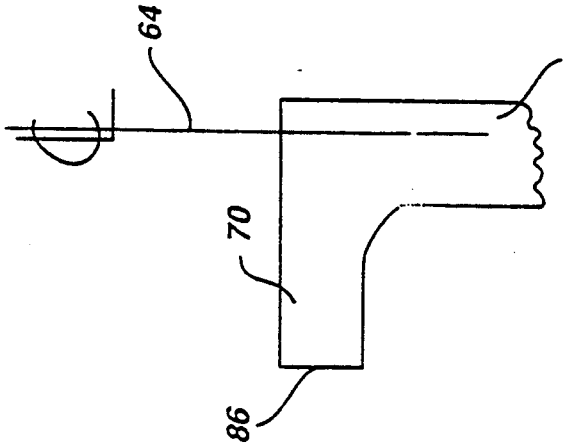

A raker tooth 44 having an open face on the left-hand side has a raker 46 extending towards the left from a body portion 66, with a distal edge 86 on the left-hand side of the center plane 64. The body portion 66 may overlap the center plane 64 of the saw chain, as shown in FIGS. 7 and 18*c*, or it may be on the right-hand side, as shown in FIG. 18*d*. A raker tooth 52 having an open face on the right-hand side has a raker 54 extending towards the right from a body portion 72, with the distal edge 75 on the right-hand side of the saw chain center plane, as shown in FIG. 15. The body portion 72 may be at the center plane 64 of the saw chain or on the left-hand side. In the preferred embodiment of this invention, the raker teeth are center-mounted, half-width rakers, as shown in FIGS. 11 and 15. Alternatively, full-width raker teeth having an open face on the appropriate side, either the left-hand side, as shown in FIGS. 11*a* and 18*d*, or on the right-hand side (not shown), may be used. Alternatively, the raker tooth may be center-mounted, having a body portion 66 extending near the center plane and rakers extending towards both the left and right sides, being a full-width raker having an open face on both sides, which is sometimes known as a "tee raker," as illustrated in U.S. Pat. No. 2,387,064, to Forrest, incorporated herein by reference. Other shapes of raker teeth, having an open face on the appropriate side, may be used.

The depth gauges as shown are center-mounted and integral with the respective cutter and raker teeth. Alternatively, the depth gauges may be positioned offset on the opposite side of the saw chain center plane 64 than the slicer or open side of the raker. Alternatively, the depth gauge may be positioned offset on the same side of the center plane 64 as the slicer and open side of the raker. The depth gauge may be integral with the teeth, as shown, or alternatively, may be mounted on other links, as shown in U.S. Pat. Nos. 3,346,025 and 4,567,803, to Anderson, incorporated herein by reference.

The preferred method of cutting, according to the invention, is as follows. A kerf 76 having a center plane 80, a left sidewall 69 and a right sidewall 71 is to be cut by the saw chain. The center plane of the kerf 80 may or may not be identical to the center plane of the saw chain 64. A cutter tooth, having a depth gauge and a left-hand side slicer 42, strikes the kerf, forming a groove 84 on the left-hand side of the kerf, as illustrated in FIGS. 9 and 10. Each slicer severs the wood fibers on one side of the kerf and also displaces wood to form a groove at the bottom of the kerf. When the slicer contacts the wood in the kerf, the slicer flexes outward, away from the center line 80 of the kerf. The groove 84 made in the kerf 76 is located farther from the center of the kerf 80 than the physical distance of the distal edge 43 of slicer 42 from the center plane 64 of the saw chain. The shape of the kerf following the left-hand slicer cut is shown in FIG. 10.

A number of saw chain design features permit the slicer 42 to make the groove 84 farther from the center plane of the kerf 80 than the slicer is from the center plane of the saw chain 64. One design feature permits movement of the individual cutter link away from the center plane 64 of the chain. The heads 58 of rivets 59 are spaced slightly farther apart from each other than the actual mechanical width of the cutter teeth, spacer links and raker teeth. Having some spacing is essential to permit the links to pivot with respect to each other about rivets 59. The spacing, however, may be slightly greater than is necessary to permit free pivoting and thus permits the slicer tooth to move slightly away from the center plane 64. Each saw chain may have more or less room for the links to move laterally from one side to the other, depending on the saw chain design and tolerances in the manufacturing of the individual links and rivets in the saw chain. The slicer is shaped to generate a side force during the cutting operation so that the slicer is displaced outward from the centerline of the chain. The kerf is thus wider than the chain when it is not cutting. The outward displacement of the tip is permitted by twisting the teeth and the chain. The twisting can be done with little force because there is clearance between the rivets 59 and the rivet holes 107 and there is clearance between the drive root 60 and the slot in the guide bar. The root 60 has a width slightly less than the width of the slot in the guide bar. Because the holes 107 in the saw chain teeth are slightly larger in diameter than the barrel of the rivet 59, the individual teeth are permitted to flex or twist to one side or the other without moving the chain saw as a whole. U.S. Pat. No. 4,762,044, to Kolve, incorporated herein by reference, describes a slicer shape which generates a side force to move the slicer outward, away from the center plane 64 of the saw chain, though other slicer designs which cause or permit the slicer to move outward may be used interchangeably therewith. The cutter tooth can move or twist to the side so that the groove 84 left by the slicer is further from the center of the kerf than the slicer is when the saw chain is not cutting. The center plane 64 of the saw chain may or may not move with the cutter tooth.

Another design feature permits movement that is characterized by the saw chain or parts thereof moving to one side or the other of the kerf while the cutting is taking place. In this type of movement, the center plane 64 of the saw chain moves and is not aligned with the center plane 80 of the kerf. There is some slackness in the chain as it is carried by the sprocket drive around the chain guide. The entire chain itself may move slightly to one side or the other because of the looseness around the chain guide and coupling in the sprockets. Further, the width of the slot in the guide bar is greater than the width of the roots 60, permitting the chain to move to one side or the other without leaving the slot in the guide bar. The design of the chain saw as a whole, including the sprocket drive mechanism and the looseness of the saw chain on the guide, are factors which determine the amount of movement permitted by the saw chain within the kerf.

Another design feature may permit bending of the slicer 42 with respect to the main body portion of the cutter tooth. The slicer itself may flex outward during the cut, thus making the groove even further from the center of the kerf. Some or all of these design features may be combined in the same saw chain to permit the groove 84 to be spaced farther from the center of the kerf than the physical distance of the slicer 42 when wood is not being cut.

Sequentially following the cutting of the wood by the left-hand slicer is a half-width raker tooth having an open face on the left-hand side, as shown in FIG. 11. The depth gauge 47 precedes the raker and ensures that the raker cuts to the correct depth in the kerf. While the depth gauge 47 is shown as a center-mounted depth gauge, it could be on the right-hand side of the kerf 80 or on the left-hand side, if desired. The raker portion 46 of the raker tooth contacts the bottom of the kerf but not the sides of the kerf. During a cutting sequence, the distal edge 86 of raker tooth 44 does not extend as far from the center plane 80 of the kerf as did the distal edge 43 of slicer 42 when the groove was being cut. The raker portion 46 may partially overlap the groove 84 left by the slicer, or may not overlap it at all, depending on the distance of the groove 84 from the center line of the kerf 80. The leading edge 94 of the raker tooth is sharpened to cut wood from the bottom of the kerf. The half-width raker removes wood from the bottom of the kerf for its entire raker width, just over half the kerf width, plus the width of the groove, leaving the kerf cut as shown in FIG. 12. Alternatively, a full-width raker tooth extending across the full width of the bottom of the kerf having an open face on the left-hand side may be used if desired, as illustrated in FIG. 11*a*. When a full "width" raker is preceded by a single sequential cutter tooth, the raker tip from the open end travels in or near the groove formed by the slicer and the closed end of the raker tooth cuts its own side of the kerf.

At least three different kinds of rakers may be used with this saw chain: "half-width" rakers, "full-width" rakers, with the cutting edge supported on one side, and "full-width" tee rakers, with the cutting edge supported on the center of the tooth. The "half-width" raker has a cutting edge supported near the center. The open side of the raker is near the side of the kerf. A left-hand raker has the open side near the side of the kerf that is cut by a left-hand slicer. A right-hand raker has the open side near the side of the kerf that is cut by a right-hand slicer. The outer tip of the cutting edge moves in or near the groove formed by the preceding slicer. The tip of the cutting edge near the center cuts a step from the adjoining kerf bottom that was formed by the preceding raker. The cutting edge of the raker may be perpendicular to the direction the chain moves or it may be sloped either way so that the inner tip is forward and the outer tip is rearward relative to the motion of the chain, or vice versa.

The width of the "full-width" raker has a support for the cutting edge near one side of the kerf. The open side of the raker is near the opposite side of the kerf. The definition of "left-hand" and "right-hand" for these "full-width" rakers is the same as for "half-width" rakers. The "full-width" raker is actually slightly less than the width of the kerf. In the embodiment having sequential left-hand and right-hand slicers preceding the "full width" raker, the tip of the cutting edge at the closed end and the tip at the open end each travel in or near the grooves formed by preceding slicers. The cutting edge of this raker may be perpendicular to the travel of the chain or it may be sloped either way, so that the tip at the closed end is forward and the tip at the open end is rearward relative to the motion of the chain, or vice versa.

The "full-width" tee raker has a cutting edge slightly less than the width of the kerf. The outer tips of the cutting edge travel in the grooves formed by preceding slicers. The cutting edge of this raker may be perpendicular to the travel of the chain or it may be shaped like a V, with the point of the V forward and the outer tips rearward relative to the motion of the chain.

One advantage of having an open face towards the groove just cut is that the distal edge 86 may be located well short of the sidewall 69 of the kerf and still cut out the bottom of the kerf completely to the sidewall 69. Having the distal edge 86 spaced from the sidewall 69 ensures that the distal edge does not rub on the sidewall of the kerf. A second advantage applicable to one-half width rakers is that the turbulence of or from the flow of the chip is decreased. With the support of the rakers located near the center, the chips are channeled to flow to the sides of the kerf. This provides a more chip-free surface when the depth gauge is in contact with the bottom of the kerf thereby enhancing smoothness in cutting. A third advantage is that the wood is removed from the bottom surface of the kerf by a clean cut with the raker and is a smooth surface after the raker tooth has passed through the kerf.

The bottom of the kerf is left smooth because the cutting edge, the leading edge 94 of the raker 70 is sharp and partially overlaps the groove 84 or is sufficiently close so as to cut out the wood from the kerf. In the embodiment of FIG. 7, there is no groove in the right-hand side of the kerf just prior to the left-hand racker cutting the kerf, as shown in FIG. 10. Hence, the right-hand side of the bottom of the kerf does not break out but remains intact, as can be seen viewing FIG. 12. If a portion of the bottom of the kerf is broken out rather than cut, the bottom becomes jagged, bumpy and uneven at that portion. The depth gauge for the next following tooth, whether a cutter tooth or a raker tooth, would bounce on the uneven, jagged or bumpy portion, and prevent proper operation of the cutting action. A tooth does not cut properly when its depth gauge is traveling on an uneven, jagged or bumpy surface. Some prior art devices permit a portion of the bottom of the kerf to be broken out rather than cut. Hence, a tooth having a depth gauge integral with the tooth does not cut properly and would cut slower, in a jagged and jerky fashion, if at all. U.S. Pat. No. 3,745,870, to Lemery, illustrates a saw chain, shown in FIG. 1 of this application, in which the raker tooth cuts on the opposite side of the kerf than the groove left by the preceding slicer tooth, which causes a tendency to break out the bottom on one side of the kerf, leaving a jagged bottom over which the next depth gauge must ride. The present invention avoids this problem by ensuring that the raker cuts the bottom of the kerf on the same side as the groove left by the preceding slicer tooth. Subsequent depth gauges are provided with a smooth, cut-out surface over which they ride. In the presently preferred embodiment, the depth gauge is integral with the cutter and raker tooth and is slightly ahead of it. Alternatively, the depth gauges may be mounted on separate links.

Figure 16:
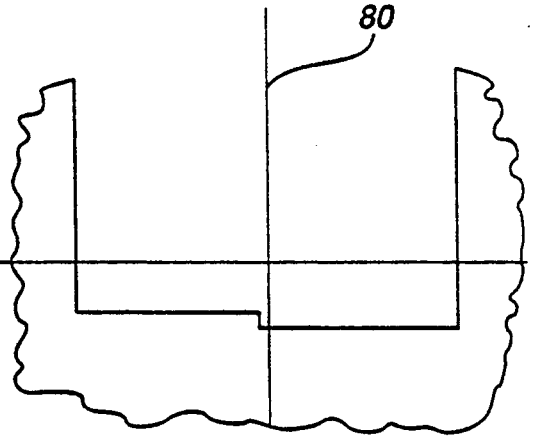
Figure 17A:
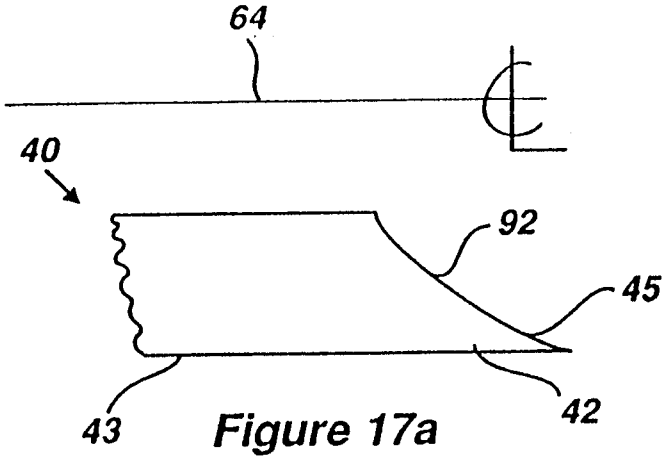
FIGS. 17*a*–17*c* are top, side and end views, respectively, of the slicer.
Figure 17C:
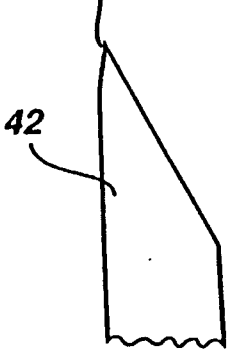
Figure 17B:
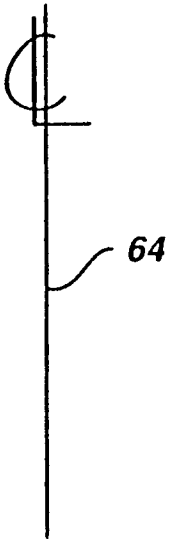
Figure 17B:
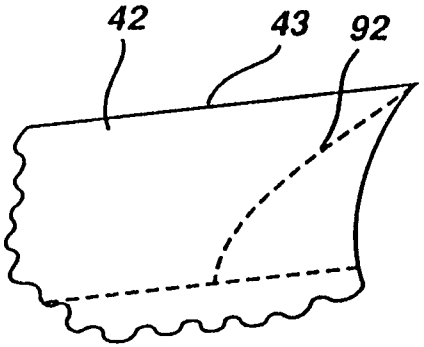

Sequentially following the raker tooth having an open face on the left-hand side is a cutter tooth having a slicer 50 on the right-hand side. The slicer 50 includes a distal edge 51 extending away from the center of the saw chain 64. The right-hand slicer cuts wood on the side of the kerf and leaves a groove 88 farther away from the center of the kerf 80 than the distance of the distal tip 51 from the center plane of the saw chain 64 when the slicer is not cutting wood, for the same reasons discussed with respect to the left-hand slicer. Sequentially following the right-hand side slicer tooth is a raker tooth 52 having an open face on the right-hand side, as shown in FIG. 15. The raker tooth is preferably a half-width raker tooth, having the main portion 72 extending from the center of the kerf ending in a distal tip 75. The raker 54 may partially overlap the groove 88 left by the previous slicer or may not quite overlap it. The raker tooth 52 removes the wood from the bottom of the kerf with a cut, as shown in FIG. 16 and previously described with respect to the raker tooth 44 having an open face on the left-hand side.

The sequence of teeth is repeated following the raker tooth 52. That is, another cutter tooth 40 having a slicer 42 on the left-hand side follows the raker tooth 52. A raker tooth 44 having an open face at the left-hand side follows this slicer tooth.

The sequence of slicers and rakers varies with the type of raker used. The preferred sequence with "half-width" rakers is as follows: left-hand slicer, left-hand raker, right-hand slicer, right-hand raker, and repeat. The preferred sequence with "full-width" rakers with support on one side, as shown in FIG. 18*d*, is as follows:

left-hand slicer, right-hand slicer, left-hand raker, right-hand slicer, left-hand slicer, right-hand raker, and repeat. The preferred sequence with "full-width" tee rakers is as follows: left-hand slicer, right-hand slicer, tee raker, right-hand slicer, left-hand slicer, tee raker, and repeat.

The particular sequence as described provides a rapid, smooth and nonbinding method of cutting the wood: specifically, cutting with a cutter tooth having a left-hand slicer sequentially followed by a raker tooth having an open face on the left-hand side sequentially followed by a cutter tooth having a right-hand slicer sequentially followed by a raker tooth having an open face on the right-hand side and repeating the sequence in the same order for the entire cut whole saw chain. This sequence is found to be particularly advantageous in soft or wet wood. One of the advantages of this unique arrangement of slicer and raker teeth is that the cut in the kerf is significantly wider than the physical width of the saw chain. Previous saw chains have cut or have attempted to cut a kerf wider than the physical width of the saw chain. However, because of the design of the cutter teeth, sequence of raker and slicer teeth, or other factors, cutting a kerf significantly wider than the saw chain was difficult, if possible at all. A further disadvantage of cutting with prior saw chains is that if the kerf narrowed, for example, because the wood expanded into the kerf, or the like, the teeth might rub on both of the sidewalls simultaneously, causing significant drag. The present invention solves this problem with the particular sequential combination of cutter teeth followed by a raker tooth with an open face on the same side as the slicer of the cutter tooth.

When using the saw chain of the present invention, if the distal edge of a tooth should rub against the sidewall of the kerf, the tooth can be deflected inward to avoid significant friction forces. A center-mounted, half-width raker tooth permits significant deflection of the raker tooth, as does a single slicer tooth. Significant swelling of the wood into the kerf is permitted, while ensuring that the teeth do not rub on both sides of the kerf at the same time. The deflection is allowed because each cutter tooth has a single slicer, the overall width of the cutter tooth being significantly less than that of the kerf and even significantly less than that of the saw chain. Similarly, a half-width raker may deflect inward because the width of the raker tooth is significantly less than the width of the kerf and even significantly less than the width of the saw chain. A full-width raker may deflect inward as the width of the full-width raker tooth is less than the width of the kerf, as cut by this inventive saw chain. The full-width raker has a width less than the width of the saw chain when the saw chain is cutting.

Alternative embodiments of cutting sequences include cutting with sequential cutter teeth, first cutting with a tooth having a slicer on the left-hand side and then with a cutter tooth having a slicer on the right-hand side. When both sides of the kerf have grooves therein made by sequential cutter teeth with single slicers, then respective raker teeth, having respective rakers and an open face on the respective right and left-hand sides, may follow cutting wood from the bottom of the kerf. Alternatively, a single raker tooth having a full-width raker having an open face on the same side as the slicer may follow the cutter teeth.

While wood had been described as the material to be cut, other materials, such as ice, ore, locker meat, paper, coal or many different materials, may be cut herewith. While the saw chain has been described as being mounted on a chain saw with a guide bar and motor, it may be placed on some other saw or driving device and driven by some connection other than roots 60 as part of each tooth.

A significant advantage of the saw chain according to the present invention is the smoothness and lack of vibration when cutting and the nonbinding of the saw chain in soft and wet woods. While a particular embodiment of the saw chain has been described in detail, other saw chain designs which are equivalent may be designed and built by those of ordinary skill in the art and fall within the scope of this invention.

I claim:

1. The method of cutting material, comprising:

forming a first groove in said material on a first side and bottom of a kerf with a first cutter tooth, said first cutter tooth including a first cutter tooth leading depth gauge and a first slicer, said first cutter tooth depth gauge being positioned forward of said first slicer;

cutting material from the bottom of said kerf with a first raker tooth, said first raker tooth including a first raker tooth leading depth gauge and a first raker, said first raker tooth depth gauge being positioned forward of said first raker;

forming a second groove in said material on the other side and bottom of said kerf with a second cutter tooth, said second cutter tooth including a second cutter tooth leading depth gauge and a second slicer, said second cutter tooth depth gauge being positioned forward of said second slicer; and cutting material from the bottom of said kerf with a second raker tooth, said second raker tooth including a second raker tooth depth gauge and a second raker, said second raker tooth depth gauge being positioned forward of said second raker.

2. The method according to claim 1 wherein each of said raker teeth is a half-width raker tooth having an open face towards the side of the kerf having said groove formed by a sequentially preceding respective cutter tooth.

3. The method according to claim 1 wherein each of said raker teeth is a full-width raker tooth having an open face towards said groove.

4. The method according to claim 1 wherein each of said raker teeth is a half-width raker tooth having an open face towards the opposite side of said kerf in the side having said groove formed by a sequentially preceding respective cutter tooth.

5. The method according to claim 1 wherein said saw chain design permits a distal edge of each of said cutter teeth to move outward when said respective slicers contact said material, causing said grooves to be located farther from a center plane of said kerf than the distal edge of said teeth are located from the center plane of the saw chain when said teeth are not cutting.

6. The method according to claim 1, wherein said first raker tooth depth gauge contacts said kerf generally in the center of said kerf prior to cutting material from the bottom of said kerf with said first raker tooth on said first side.

7. The method according to claim 1 wherein said raker teeth have a leading edge sloping backwards from the leading point toward the outside of the saw chain.

8. The method according to claim 1 wherein said raker teeth have a leading edge extending generally perpendicular to the direction of motion of said saw chain during a cutting operation.

9. A saw chain having a plurality of links, comprising:

a first cutter tooth having a first single slicer and a first cutter tooth depth gauge positioned forward of said first slicer, said first slicer being on the left-hand side;

a first raker tooth having a first raker and a first raker tooth depth gauge positioned forward of said first raker and in the same relative lateral position as the depth gauge on the first cutter tooth to ensure that said first raker depth gauge is measuring at approximately the same position in the kerf as said first slicer's depth gauge, said first raker tooth having an open face on the left-hand side, and having a first main body portion overlapping a central region of said kerf to cleanly cut wood from said kerf in said central region;

a second cutter tooth having a second single slicer and a second cutter tooth depth gauge positioned forward of said second slicer, said second slicer being on the right-hand side; and a second raker tooth having a second raker and a second raker tooth depth gauge positioned forward of said second raker and in the same relative lateral position as the depth gauge on the second cutter tooth to ensure that said second raker's depth gauge is measuring at approximately the same position in the bottom of the kerf as said second slicer's depth gauge, said second raker tooth having an open face on the right-hand side, and a second main body portion overlapping a central region of said kerf to cleanly cut wood from said kerf in said central region, the slicers and the rakers alternating on said saw chain, one of said rakers sequentially following one of said slicers.

10. The saw chain according to claim 9 wherein said first raker tooth having an open face on the left-hand side sequentially follows said first cutter tooth having said first slicer on the left-hand side in the direction of the cut.

11. The saw chain according to claim 9 wherein said first raker tooth having an open face on the left-hand side sequentially follows said second cutter tooth having said second slicer on the right-hand side in the direction of the cut.

12. The saw chain according to claim 9 wherein said second raker tooth having an open face on the right-hand side sequentially follows said second cutter tooth having said second slicer on the right-hand side in the direction of the cut.

13. The saw chain according to claim 9 wherein a leading edge of said slicers slopes backwards toward the center of the saw chain from the leading point of said slicers.

14. The saw chain according to claim 9 wherein a distal edge of said slicers slopes backwards toward the outside of the saw chain from the leading point of said slicers.

15. The saw chain according to claim 9 wherein a leading edge of said rakers slopes backwards toward the outside of the saw chain from the leading point of said rakers.

16. The saw chain according to claim 9 wherein a leading edge of said rakers extends generally perpendicular to the direction of motion of said saw chain during a cutting operation.

17. The saw chain according to claim 9 wherein said rakers are half-width rakers having a width significantly less than the width of said saw chain.

18. The saw chain according to claim 9 wherein said rakers are full-width rakers having a width slightly less than the width of said saw chain.

19. The saw chain according to claim 9 wherein the distance from the center of the saw chain to a distal point of one of said slicers is greater than the distance from the center of said saw chain to a distal point of one of said rakers.

20. The saw chain according to claim 9 wherein said second raker tooth having an open face on the right hand side, sequentially follows said first cutter tooth having a slicer on the left hand side in the direction of the cut.

21. The saw chain according to claim 9, wherein the depth gauge on said first slicer tooth and said raker tooth are on the left hand side and the respective depth gauges on the second cutter tooth and the second raker tooth are on the right hand side.

22. The saw chain according to claim 9, wherein each depth gauge is center-mounted on each respective tooth.

23. A saw chain comprising:

a first cutter tooth having a first single slicer and a first depth gauge positioned forward of said first single slicer, said first slicer being on a first side;

a first raker tooth having a first single half-width raker and having an open face on said first side and a first main body portion overlapping a central region of said kerf to cleanly cut wood from said kerf in said central region, a distal edge of said first raker being adjacent a sidewall of the kerf, and a second depth gauge positioned forward of said first raker, said first raker tooth sequentially following said first cutter tooth;

a second cutter tooth having a second single slicer and a third depth gauge positioned forward of said second slicer, said second single slicer being on a second side; and a second raker tooth having a second single half-width raker having an open face on said second side and a second main body portion overlapping a central region of said kerf to cleanly cut wood from said kerf in said central region, a distal edge of said second raker being adjacent a sidewall of the kerf, and a fourth depth gauge positioned forward of said second raker, said second raker sequentially following said second cutter tooth.

24. The saw chain according to claim 23 wherein said raker tooth has an open face on the same side as the slicer of the sequentially preceding respective cutter tooth in the direction of the cut.

25. The saw chain according to claim 23 wherein said first raker tooth has an open face on said first side and said second raker tooth has an open face on said second side.

26. The saw chain according to claim 23 wherein said first raker tooth has an open face on said second side and said second raker tooth has an open face on said first side.

27. A saw chain having a plurality of links comprising:

a first cutter tooth having a first single slicer and a first depth gauge positioned forward of said first slicer, said first slicer being on the left hand side;

a first raker tooth having a first full width raker and a second depth gauge positioned forward of said first full width raker and in the same relative lateral location as the depth gauge on the first cutter tooth to ensure that said first raker depth gauge is measuring at approximately the same position in the kerf as said first slicer's depth gauge, said first raker tooth having a main body portion on a right hand side of the kerf and an open face on the left hand side, said first raker tooth sequentially following said first cutter tooth;

a second cutter tooth having a second single slicer and a third depth gauge positioned forward of said second slicer, said second slicer being on the right hand side and sequentially following said first raker tooth; and a second raker tooth having a second full width raker and a fourth depth gauge positioned forward of said second full width raker and in the same relative lateral position as the depth gauge on the second cutter tooth to ensure that said second raker's depth gauge is measuring at approximately the same position in the bottom of the kerf as said second slicer's depth gauge, said second raker tooth having a main body portion on a left hand side of the kerf and an open face on the right hand side, said second raker tooth sequentially following said second cutter tooth.

* * * * *

UNITED STATES PATENT AND TRADEMARK OFFICE

CERTIFICATE OF CORRECTION

PATENT NO. : 5,172,619

DATED : December 22, 1992

INVENTOR(S) : Gerald C. Kolve

It is certified that error appears in the above-identified patent and that said Letters Patent is hereby corrected as shown below:

In column twelve, claim 21, line 18, after the second "said" and before "raker", please insert --first--.

Signed and Sealed this

First Day of February, 1994

Bruce Lehman

*Attest:*

BRUCE LEHMAN

*Attesting Officer*

*Commissioner of Patents and Trademarks*